US011933521B2

(12) United States Patent
Hamagami et al.

(10) Patent No.: US 11,933,521 B2
(45) Date of Patent: Mar. 19, 2024

(54) HOT WATER SUPPLY DEVICE

(71) Applicant: NORITZ CORPORATION, Hyogo (JP)

(72) Inventors: Toshihiko Hamagami, Hyogo (JP); Hideyuki Okada, Hyogo (JP); Kenta Yamanishi, Hyogo (JP); Hisataka Hayase, Hyogo (JP); Kazuhiro Nishimura, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/546,057

(22) Filed: Dec. 9, 2021

(65) Prior Publication Data

US 2022/0196290 A1 Jun. 23, 2022

(30) Foreign Application Priority Data

Dec. 22, 2020 (JP) ..... 2020-212283
Dec. 22, 2020 (JP) ..... 2020-212284

(51) Int. Cl.
*F24H 15/104* (2022.01)
*F24H 1/00* (2022.01)

(52) U.S. Cl.
CPC ..... *F24H 15/104* (2022.01); *F24H 1/0036* (2013.01)

(58) Field of Classification Search
None
See application file for complete search history.

(56) References Cited

FOREIGN PATENT DOCUMENTS

| | | | |
|---|---|---|---|
| JP | 2002149865 | | 5/2002 |
| JP | 3320933 | B2 * | 9/2002 |
| JP | 2013137000 | A * | 7/2013 |

OTHER PUBLICATIONS

JP-3320933-B2 English translation (Year: 2002).*
JP-2013137000-A English translation (Year: 2013).*
WHG, Tankless Water Heater Venting Installation Tips (Year: 2020).*

* cited by examiner

*Primary Examiner* — Steven S Anderson, II
*Assistant Examiner* — Kurt J Wolford
(74) *Attorney, Agent, or Firm* — JCIPRNET

(57) ABSTRACT

A hot water supply device includes a combustion part, a combustion fan, a heat exchange part, a water supply part, a hot water discharge part, and a control part. In the hot water supply device, in a pre-purge step of a heating operation, the presence or absence of a disturbance factor is determined based on rotational responsiveness and deviation of the combustion fan with respect to a scavenging rotation speed. When there is no disturbance factor, in an ignition step, detection of a failure sign is performed based on responsiveness and deviation of the combustion fan with respect to an ignition rotation speed.

3 Claims, 6 Drawing Sheets

HOT WATER SUPPLY DEVICE

CROSS-REFERENCE TO RELATED APPLICATION

This application claims the priority benefit of Japan application serial no. 2020-212283, filed on Dec. 22, 2020, and Japan application serial no. 2020-212284, filed on Dec. 22, 2020. The entirety of each of the above-mentioned patent applications is hereby incorporated by reference herein and made a part of this specification.

BACKGROUND

Technical Field

The disclosure relates to a combustion type hot water supply device, and more particularly to a hot water supply device configured to detect a failure sign before a failure occurs in a combustion part.

Description of Related Art

Conventionally, as in the case of the hot water supply device of Patent Literature 1, for example, a technique for detecting a failure sign due to deterioration of the combustion fan based on the rotational responsiveness and deviation with respect to the target rotation speed of the combustion fan has been known. Since the usable period (life) of the hot water supply device is predicted based on the progress of deterioration of the combustion fan, it is useful for considering countermeasures such as parts replacement and replacement of the hot water supply device.

RELATED ART

Patent Literature

[Patent Literature 1] Japanese Laid-open No. 2002-149865

SUMMARY

Technical Problem

However, the rotational responsiveness and deviation of the combustion fan with respect to the target rotation speed are likely to fluctuate due to disturbance factors such as the influence of the outside air that blows into the exhaust port and flows back when the weather is very windy; therefore, there is a risk of falsely detecting a failure sign.

Further, the ignition time of the combustion part tends to be long because the capacity of the ignition device tends to decrease, for example, at a low temperature. In addition, since the amount of air blown by the combustion fan is reduced to facilitate ignition of the mixture of fuel gas and air during ignition, in strong winds, the ignition time tends to be long due to the influence of the outside air that blows into the exhaust port and flows back. As described above, the ignition time is likely to fluctuate due to disturbance factors; therefore, there is a risk of falsely detecting a failure sign.

The disclosure provides a hot water supply device capable of preventing false detection of a failure sign of a combustion part and detecting a failure sign and prompting an inspection before the failure.

Solution to the Problem

A hot water supply device according to the disclosure includes: a combustion part; a gas supply part for supplying fuel gas to the combustion part; a combustion fan for supplying combustion air to the combustion part; a heat exchange part; a water supply part; a hot water discharge part; and a control part. The hot water supply device is configured to perform a heating operation in which hot water supplied from the water supply part is heated in the heat exchange part by combustion heat generated in the combustion part to discharge the hot water at the hot water discharge part, and the control part performs detection and notification of a failure sign of a plurality of elemental components configuring the hot water supply device based on responsiveness and deviation with respect to a control target value in the heating operation. In the hot water supply device, the heating operation is operated by controlling a plurality of steps set for each of the plurality of elemental components, and the control part determines a status of the hot water supply device based on responsiveness and deviation with respect to a control target value detected in an initial step among the plurality of steps, and when it is determined that the status is normal, the control part performs the detection of the failure sign based on responsiveness and deviation with respect to a control target value detected in a next step following the initial step.

According to the above configuration, the status of the hot water supply device is determined by the responsiveness and the deviation corresponding to the control target value detected in the initial step among the plurality of steps, and when the status is determined to be normal, the failure sign is determined based on the responsiveness and deviation with respect to the control target value in the next step following the initial step. Therefore, it is possible to perform highly accurate failure sign detection that is not affected by disturbance or the like.

The disclosure may employ various preferred embodiments such as the following ones.

First Embodiment

The heating operation includes: a pre-purge step, which is the initial step that drives the combustion fan for a predetermined time with the target rotation speed set to a predetermined scavenging rotation speed; and an ignition step, which is the next step that drives the combustion fan with the target rotation speed set to a predetermined ignition rotation speed after the pre-purge step and performs an ignition operation. In the pre-purge step, the control part determines a presence or absence of a disturbance factor from the outside based on the rotational responsiveness and the deviation of the combustion fan with respect to the scavenging rotation speed, which is the control target value, and when it is determined that there is no disturbance factor, in the ignition step, the control part performs the detection of the failure sign based on the rotational responsiveness and the deviation of the combustion fan with respect to the ignition rotation speed, which is the control target value.

According to the above configuration, the presence or absence of a disturbance factor in the pre-purge step is determined based on the rotational responsiveness and deviation with respect to the target rotation speed of the combustion fan during the heating operation, and if there is no disturbance factor, the detection of the failure sign of the combustion fan is performed in the ignition step. Therefore, since the detection of the failure sign of the combustion fan is performed every time the heating operation is performed, it is unlikely to overlook the failure sign, and since the presence or absence of the disturbance factor is determined, it is possible to prevent false detection of the failure sign due to the disturbance.

Second Embodiment

The control part stores in advance initial data at the time of initial installation related to the rotational responsiveness and the deviation of the combustion fan, and performs the detection of the failure sign by comparing current rotational responsiveness and deviation of the combustion fan with the initial data.

According to the above configuration, since the detection of the failure sign of the combustion fan is performed by comparing with the initial data at the time of initial installation of the hot water supply device, the failure sign due to the aged deterioration of the combustion fan can be detected. Therefore, it is possible to prompt the inspection before the hot water supply device cannot be operated due to the failure in the combustion fan.

Third Embodiment

The control part stores in advance failure reference data related to the rotational responsiveness and the deviation of the combustion fan determined to have a failure, and performs the detection of the failure sign by comparing current rotational responsiveness and deviation of the combustion fan with the failure reference data.

According to the above configuration, since the detection of the failure sign of the combustion fan is performed based on the comparison with the failure reference data in which the combustion fan is determined to have a failure, the failure sign can be detected before the failure is determined. Therefore, it is possible to prompt the inspection before the hot water supply device cannot be operated due to the failure in the combustion fan.

Fourth Embodiment

The combustion part is configured to be divided into a plurality of combustion regions including an ignition region ignited at the start of the heating operation and a fire transfer region adjacent to the ignition region, and the combustion region to burn is changed according to a required combustion amount. A plurality of flame detecting parts for detecting a flame are provided corresponding to the plurality of combustion regions including the ignition region and the fire transfer region. The control part detects a flame in the ignition region that has been ignited in the ignition step, which is the initial step at the start of the heating operation, by a corresponding flame detecting part among the plurality of flame detecting parts, and determines the status of the hot water supply device based on deviation from the number of times of ignition retries, which is a control target value, and when it is determined that the status of the hot water supply device is normal, the control part performs detection of a failure sign of the combustion part based on a fire transfer time, which is a control target value when fire is transferred to the fire transfer region in a fire transfer step, which is the next step.

According to the above configuration, the ignition region of the combustion part is ignited to burn during the heating operation, and after it is determined that the hot water supply device is normal, the detection of the failure sign of the combustion part is performed based on the fire transfer time when the combustion region is expanded to the fire transfer region adjacent to the ignition region. Therefore, it is possible to prevent false detection of a failure sign due to disturbance by preventing the influence of the ignition device and the influence of strong wind.

Fifth Embodiment

The control part stores in advance initial data at the time of initial installation of the fire transfer time, and performs the detection of the failure sign by comparing a current fire transfer time with the initial data.

According to the above configuration, since the detection of the failure sign of the combustion part is performed by comparing with the initial data at the time of initial installation of the hot water supply device, the failure sign due to the aged deterioration of the combustion part can be detected. Therefore, it is possible to prompt the inspection before the hot water supply device cannot be operated due to the failure in the combustion part.

Sixth Embodiment

The control part stores in advance a fire transfer time for determining an occurrence of a blockage failure in the combustion part as a failure reference value, and when a current fire transfer time exceeds the failure reference value, the control part determines that a blockage failure has occurred in the combustion part and notifies the blockage failure of the combustion part.

According to the above configuration, the blockage failure of the combustion part is determined based on the comparison between the current fire transfer time and the failure reference value for determining the occurrence of the blockage failure in the combustion part. Therefore, it is possible to prevent erroneous determination of the blockage failure in the combustion part due to disturbance, and it is possible to notify the blockage failure in the combustion part when it is determined that the blockage failure in the combustion part has occurred.

Effects

According to the disclosure and preferred embodiments, it is possible to prevent false detection of a failure sign of a combustion fan due to disturbance, to detect a failure sign before failure, and to give a notification prompting inspection.

Further, it is possible to prevent false detection of a blockage failure sign of the combustion part due to disturbance, to detect a failure sign before failure, and to give a notification prompting inspection.

DESCRIPTION OF THE EMBODIMENTS

Hereinafter, modes for carrying out the disclosure will be described based on embodiments.

First Embodiment

Figure 1:
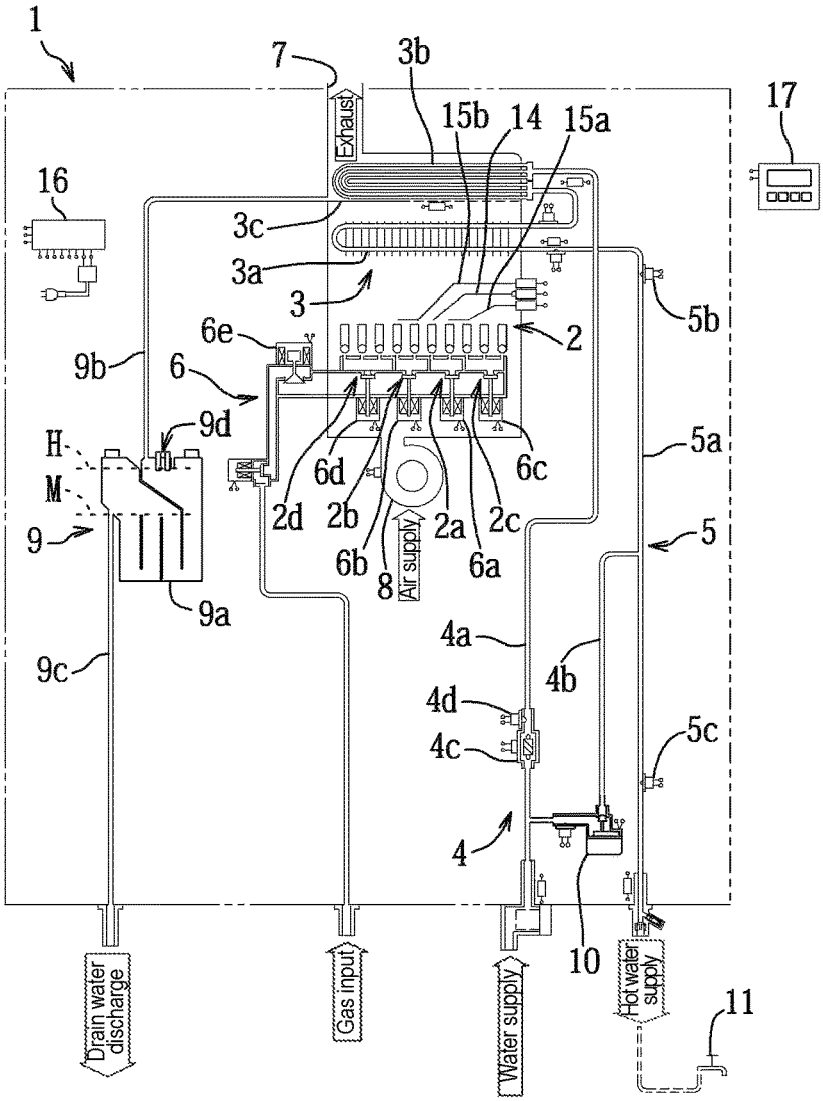
FIG. 1 is an explanatory diagram of a combustion type hot water supply device according to a first embodiment of the disclosure.

A combustion type hot water supply device 1 is usually installed outdoors. As shown in FIG. 1, the hot water supply device 1 includes a combustion part 2, a heat exchange part 3, a water supply part 4, and a hot water discharge part 5. The hot water supply device 1 is configured to perform a heating operation in which feed water supplied from the water supply part 4 is heated in the heat exchange part 3 by using the combustion heat generated by the combustion part 2 to discharge hot water at the hot water discharge part 5. A fuel supply part 6 for supplying a fuel gas (natural gas or propane gas) is connected to the combustion part 2.

To supply combustion air to the combustion part 2, to send combustion gas, which is a medium of combustion heat generated by combustion, to the heat exchange part 3 and to exhaust it to the outside from an exhaust port 7, a combustion fan 8 is provided in the vicinity of the combustion part 2. The combustion part 2 is divided into, for example, first to fourth combustion regions 2*a* to 2*d* as a plurality of combustion regions in which the fuel gas supplied from the fuel supply part 6 and the combustion air are mixed and burned, and the combustion region to burn is changed according to the required combustion amount for generating the required heat amount.

The fuel supply part 6 includes first to fourth gas solenoid valves 6*a* to 6*d* corresponding to the first to fourth combustion regions 2*a* to 2*d*, and a fuel flow rate adjusting valve 6*e* for adjusting the fuel flow rate to be supplied to the combustion part 2. The fuel supply part 6 is configured so that the fuel flow rate can be adjusted and the supply/stop of the fuel gas can be individually switched for the first to fourth combustion regions 2*a* to 2*d*.

The heat exchange part 3 has a fin-and-tube type first heat exchanger 3*a* and a second heat exchanger 3*b* configured by a plurality of hot- and cold-water passages. The first heat exchanger 3*a* recovers the sensible heat of the high-temperature combustion gas immediately after combustion to heat the hot water. The second heat exchanger 3*b* recovers the latent heat of the combustion gas whose sensible heat has been recovered and whose temperature has dropped to heat the feed water.

In the second heat exchanger 3*b*, the water included in the combustion gas is condensed to generate condensed water. This condensed water includes a component of combustion gas and is strongly acidic. Therefore, since it is inappropriate to discharge the water as it is, it is introduced into a neutralization tank 9*a* including, for example, calcium carbonate particles as a neutralizing agent, and is discharged after being neutralized. The combustion gas whose temperature has dropped after the latent heat is recovered by the second heat exchanger 3*b* is exhausted to the outside through the exhaust port 7.

An introduction passage 9*b*, which guides the condensed water that has fallen into a drain pan 3*c* arranged under the second heat exchanger 3*b* to the neutralization tank 9*a*, and a discharge passage 9*c*, which discharges the neutralized condensed water to the outside of the hot water supply device 1, are connected to the neutralization tank 9*a* to form the neutralizer 9. A pair of electrode rods 9*d* is provided at the upper end of the neutralization tank 9*a* as a water level detecting part for detecting the water level (predetermined water level) of the condensed water. A voltage is applied between the pair of electrode rods 9*d*, and a current flows through the condensed water between the pair of electrode rods 9*d* that has come into contact with the condensed water at a predetermined water level, thereby detecting the predetermined water level.

The water supply part 4 includes a water supply passage 4*a* for supplying the feed water supplied from the water source to the second heat exchanger 3*b*, and a water supply branch passage 4*b* branched from the water supply passage 4*a* and provided with a flow rate adjusting valve 10. The hot water heated by the second heat exchanger 3*b* is introduced into the first heat exchanger 3*a* and heated to a higher temperature. The hot water heated by the first heat exchanger 3*a* is supplied to the hot water discharge passage 5*a*. In the hot water discharge part 5 formed by connecting the water supply branch passage 4*b* to the hot water discharge passage 5*a*, the heated hot water and feed water are mixed to adjust the temperature, and hot water is supplied to a hot water supply destination such as a hot water tap 11.

The first combustion region 2*a* of the combustion part 2 is an ignition region that ignites and burns first when the heating operation is started. An ignition device 14 that generates sparks by electric discharge and a first flame rod 15*a* serving as a flame detecting part for detecting a flame in the first combustion region 2*a* for ignition confirmation are arranged at a position corresponding to the first combustion region 2*a*.

The second combustion region 2*b* adjacent to the first combustion region 2*a* is a fire transfer region to which the combustion region is first expanded from the first combustion region 2*a* in order to increase the amount of combustion and increase the generation of combustion heat. A second flame rod 15*b* serving as a flame detecting part for detecting the flame in the second combustion region 2*b* is arranged at a position corresponding to the second combustion region 2*b*. The amount of combustion can be increased by expanding the combustion regions to the third and fourth combustion regions 2*c* and 2*d*. Further, flame rods corresponding to the third and fourth combustion regions 2*c* and 2*d* serving as flame detecting parts for detecting the flames in the third and fourth combustion regions 2*c* and 2*d* may be arranged.

The water supply passage 4*a* is provided with a water supply flow rate sensor 4*c* for detecting the flow rate of feed water supplied to the heat exchange part 3 and a water supply temperature sensor 4*d* for detecting the water supply temperature. A hot water discharge temperature sensor 5*b* for detecting the hot water discharge temperature of the hot water heated by the heat exchange part 3 is arranged in the hot water discharge passage 5*a*. A hot water supply temperature sensor 5*c* for detecting the hot water supply temperature of hot water whose temperature is adjusted by mixing with feed water is arranged on the downstream side of the connection part of the hot water discharge passage 5*a* and the water supply branch passage 4*b*.

The hot water supply device 1 includes a control part 16 that controls a heating operation in order to supply hot water at a hot water supply set temperature based on a water supply flow rate, a water supply temperature, and a hot water discharge temperature. The hot water supply set temperature is set by the operation of an operation terminal 17 connected to the control part 16. In the heating operation, the control part 16 calculates the required combustion amount (required heat amount) based on, for example, the hot water supply set temperature, the water supply flow rate, and the water supply temperature. Then, the control part 16 sets the combustion region to burn of the combustion part 2, the target rotation speed of the combustion fan 8, and the fuel flow rate of the fuel supply part 6 in order to generate the required heat amount. Further, the control part 16 adjusts the opening degree of the flow rate adjusting valve 10 and adjusts the mixing ratio of the feed water and the heated hot water so that the hot water supply temperature approaches the hot water supply set temperature.

Figure 2:
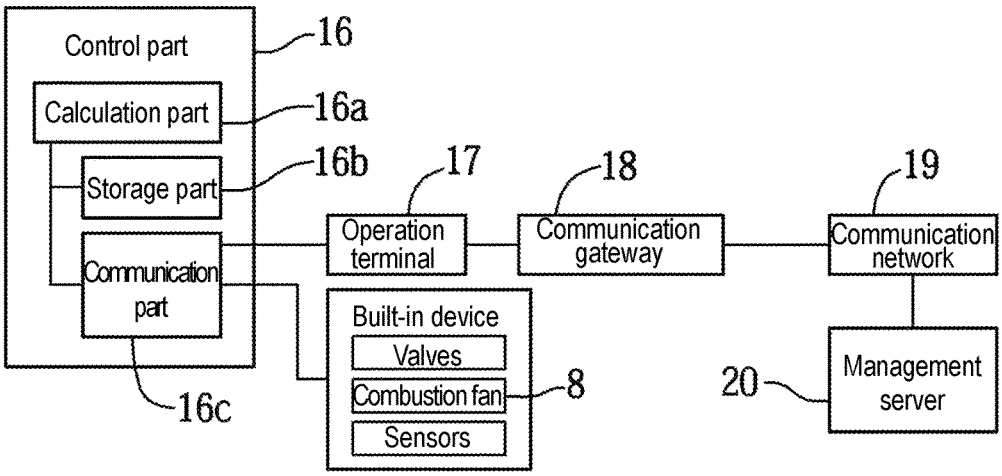
FIG. 2 is an explanatory diagram of a configuration of a control part and a communication path of the hot water supply device.

As shown in FIG. 2, the control part 16 includes a calculation part 16*a* that executes various control programs, a storage part 16*b* that stores various control programs, control parameters, and the like, and a communication part 16*c*. The calculation part 16*a* controls the valves of the flow rate adjusting valve 10 and the fuel supply part 6 and the combustion fan 8 via the communication part 16*c* that communicates with the built-in devices of the hot water supply device 1 and the operation terminal 17, and also receives the detection signals of sensors such as the water supply temperature sensor 4*d* and the operation contents of the operation terminal 17.

The operation terminal 17 is connected to an external communication network 19 (Internet) via, for example, a communication gateway 18 having a home network construction function. A management server 20 installed by a service shop or a manufacturer that installs and maintains the hot water supply device 1 is connected to the communication network 19 to manage information about currently installed hot water supply devices and other equipment, including the hot water supply device 1. As a result, the control part 16 can communicate with the management server 20. Further, the communication part 16*c* or the operation terminal 17 may be directly connected to the communication network 19.

Figure 3:
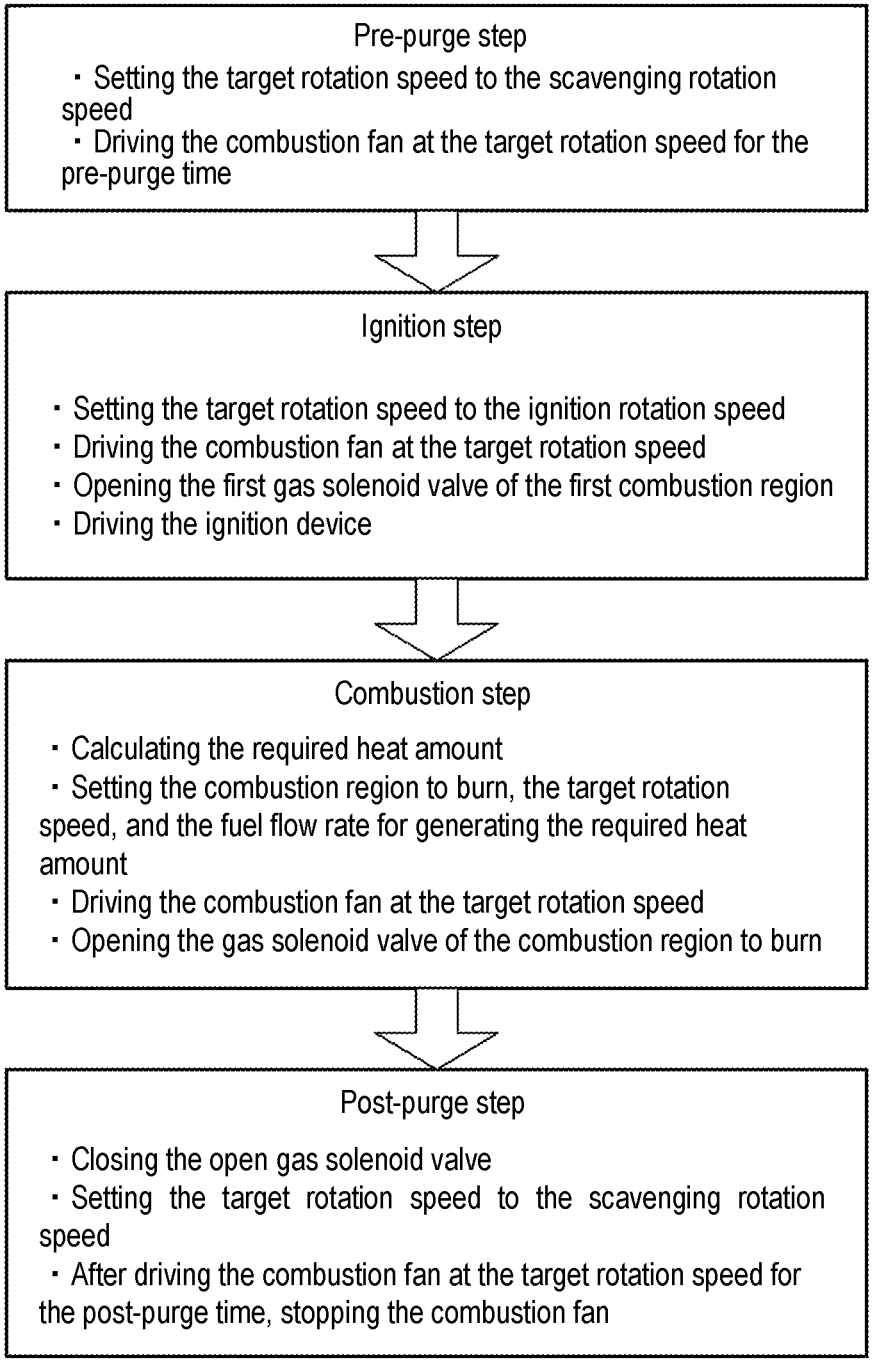
FIG. 3 is a step explanatory view of a heating operation of the hot water supply device.

When the water supply flow rate detected by the water supply flow rate sensor 4*c* becomes greater than or equal to a predetermined minimum flow rate due to the start of use of the hot water supply, the heating operation is started. As shown in FIG. 3, the heating operation is divided into a pre-purge step, an ignition step, a combustion step, and a post-purge step. In the pre-purge step, the target rotation speed of the combustion fan 8 is set to the scavenging rotation speed (for example, 3000 rpm), and the combustion fan 8 is driven at the scavenging rotation speed for a predetermined pre-purge time (for example, 5 seconds). As a result, the air staying in the combustion part 2 and the heat exchange part 3 is exhausted from the exhaust port 7, and the rotation speed of the combustion fan 8 that was stopped increases to about the scavenging rotation speed.

When the target rotation speed is changed, the difference of the rotation speed by which the actual rotation speed is greater or less than the target rotation speed is the deviation from the target rotation speed of the combustion fan 8. The larger the deviation, and for longer duration the deviation is large, including the case where the actual rotation speed is not stable, the greater the decrease in the rotational responsiveness of the combustion fan 8.

Next, the process proceeds to the ignition step, in which a first gas solenoid valve 12*a* corresponding to the first combustion region 2*a* (ignition region) is opened, and the target rotation speed is set to the ignition rotation speed (for example, 2500 rpm), and the combustion fan 8 is driven at the ignition rotation speed. Then, the ignition device 14 is driven to ignite the first combustion region 2*a* as an ignition operation. When the flame in the first combustion region 2*a* is detected (ignition confirmed) by the first flame rod 15*a*, the process proceeds to the combustion step.

Next, in the combustion step, the combustion region to burn of the combustion part 2, the target rotation speed of the combustion fan 8, and the fuel flow rate of the fuel supply part 6 are set so that the calculated required heat amount can be supplied. Then, the combustion fan 8 is driven at the target rotation speed; the fuel gas solenoid valve corresponding to the combustion region to burn is opened; fuel is supplied at the set fuel flow rate; the required heat amount is generated; and hot water is supplied at the hot water supply set temperature.

When the water supply flow rate becomes less than the predetermined minimum flow rate due to the end of hot water supply use, the process proceeds to the post-purge step. In the post-purge step, all open gas solenoid valves are closed; combustion of the combustion part 2 is stopped; the target rotation speed is set to the scavenging rotation speed; and the combustion fan 8 is driven at the scavenging rotation speed for a post-purge time (for example, 10 seconds). As a result, the combustion gas is exhausted so as not to remain in the combustion part 2 and the heat exchange part 3. Finally, the combustion fan 8 is stopped, and the heating operation is completed.

When installing the hot water supply device 1, a trial run is performed to confirm that the hot water supply device 1 operates normally. The control part 16 stores the heating operation data at the time of the trial run in the storage part 16*b* or the storage area of the management server 20 as the initial data at the time of initial installation.

In the heating operation, normally, the combustion fan 8 can be controlled roughly according to the target rotation speed at the time of initial installation of the hot water supply device 1, but it gradually becomes impossible to be adjusted to the target rotation speed due to aged deterioration. Then, when the combustion fan 8 reaches the failure standard by which it is determined to have a failure, the control part 16 prohibits the heating operation, and for example, the operation terminal 17 notifies the user of the occurrence of a failure in the combustion fan 8, and the installation and maintenance company is notified of the occurrence of a failure in the combustion fan 8 via the management server 20. The user or the installation and maintenance company that is notified of the occurrence of this failure arranges inspection and repair.

Figure 4:
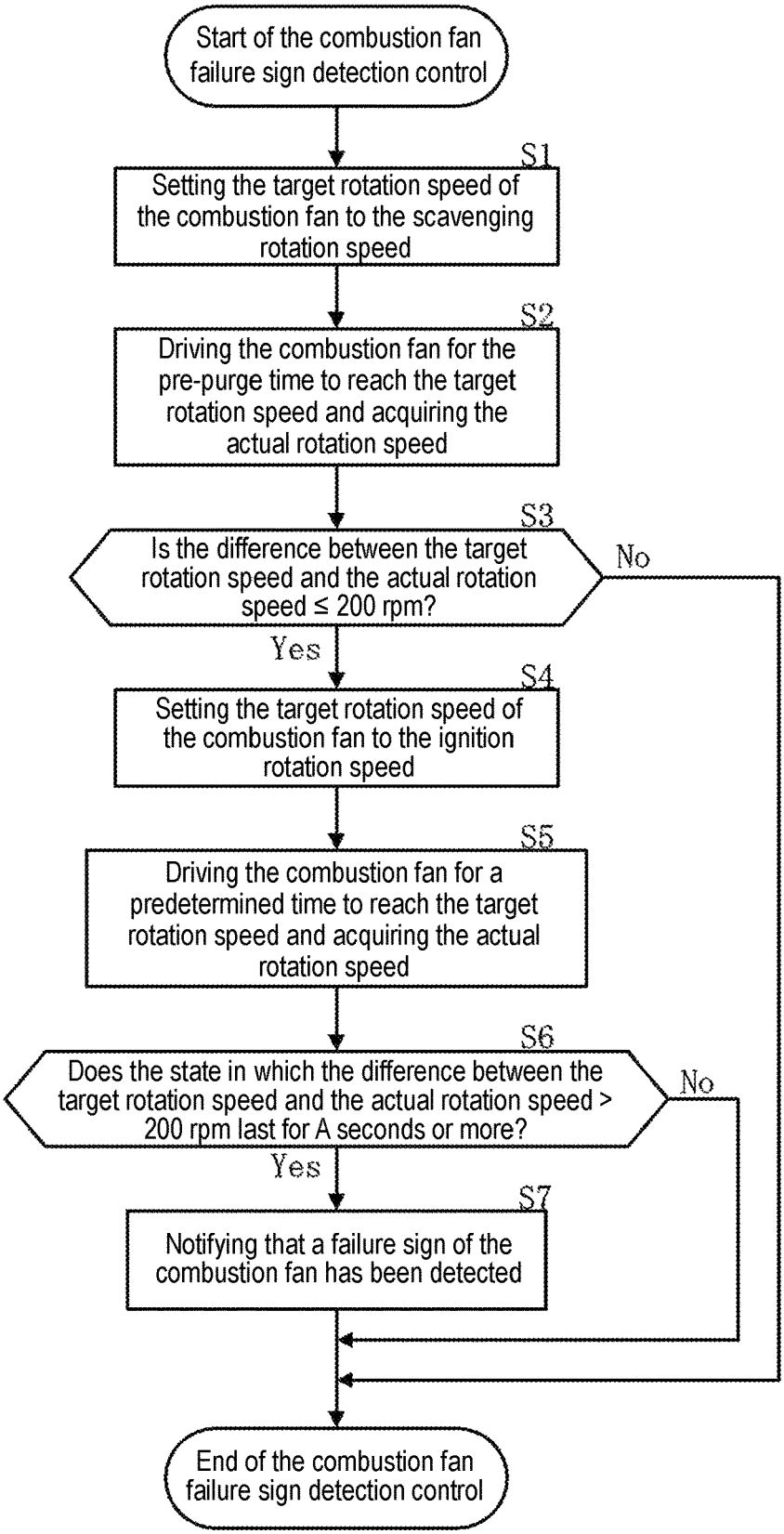
FIG. 4 is a flowchart of a combustion fan failure sign detection control according to a first detection example.

If only the occurrence of a failure in the combustion fan 8 is notified, it causes inconvenience because the hot water supply device 1 cannot be used from the occurrence of the failure to the completion of inspection and repair. Therefore, a failure sign is detected before the combustion fan 8 has a failure, and the management server 20 is notified that there is a failure sign. The failure sign detection will be described based on FIG. 4 with reference to the flowchart of the combustion fan failure sign detection control according to the first detection example. Si (i=1, 2, . . . ) in the figure represents a step.

When the combustion fan failure sign detection control is started at the same time as the start of the heating operation, the target rotation speed of the combustion fan 8 is set to the scavenging rotation speed in S1, and the process proceeds to S2. In S2, the combustion fan 8 is driven for a pre-purge time (for example, 5 seconds) so as to reach the target rotation speed, and the actual rotation speed during that period is acquired, and the process proceeds to S3.

In S3, it is determined whether the difference between the target rotation speed and the actual rotation speed (absolute value of deviation) is less than or equal to a predetermined reference value (for example, 200 rpm). For example, when the weather is very windy, the wind blows into the exhaust port 7 from the outside and flows back, which may hinder the rotation of the combustion fan 8 and cause a disturbance that decreases the actual rotation speed. If there is such a disturbance factor, there is a risk of falsely detecting a failure sign of the combustion fan 8. S3 is a step for eliminating the possibility of this false detection.

If the determination in S3 is Yes, the process proceeds to S4 assuming that there is no disturbance factor. If the determination in S3 is No, it is assumed that there is a disturbance factor, and the combustion fan failure sign detection control is ended, and the heating operation is continued. The process up to this point corresponds to the pre-purge step, and the process proceeds to the next ignition step.

In S4, the target rotation speed of the combustion fan 8 is set to the ignition rotation speed, and the process proceeds to S5. Since the region to burn is limited to the first combustion region 2*a* (ignition region), and since it becomes difficult to ignite when the amount of air blown is large, the ignition rotation speed is set to a lower rotation speed than the scavenging rotation speed. Then, in S5, the combustion fan 8 is driven for a predetermined time (for example, 7 seconds) so as to reach the ignition rotation speed that is the target rotation speed, and the actual rotation speed during that period is acquired, and the process proceeds to S6.

In S6, it is determined whether the state in which the difference between the target rotation speed and the actual rotation speed exceeds 200 rpm lasts for A seconds (for example, 5 seconds) or more. Since it has already been determined in S3 that there is no disturbance factor, the state in which the deviation from the target rotation speed is large and the duration thereof represent the current degree of deterioration of the combustion fan 8 in which the rotational responsiveness has deteriorated.

If the determination in S6 is Yes, the process proceeds to S7. In this case, since the deterioration of the combustion fan 8 has progressed to some extent, in S7, it is notified that the failure sign of the combustion fan 8 has been detected, and the combustion fan failure sign detection control is ended, and the process proceeds to the combustion step to continue the heating operation. At this time, for example, the service shop is notified via the management server 20 that a failure sign has been detected to prompt for inspection, but the user can also be notified by, for example, lighting the lamp of the operation terminal 17.

On the other hand, when the determination in S6 is No, the deterioration of the combustion fan 8 has not progressed so much. Therefore, it is assumed that the failure sign of the combustion fan 8 has not been detected, and the combustion fan failure sign detection control is ended, and the process proceeds to the combustion step to continue the heating operation. Since the detection of the failure sign of the combustion fan 8 is performed every time the heating operation is performed as described above, it is unlikely to overlook the failure sign of the combustion fan 8. Further, since the presence or absence of a disturbance factor is determined and the failure sign detection is performed when there is no disturbance factor, it is possible to prevent the false detection of the failure sign due to the disturbance, and it is possible to reduce the amount of communication by preventing the transmission of false detection information of failure signs to the management server 20.

Second Detection Example

Figure 5:
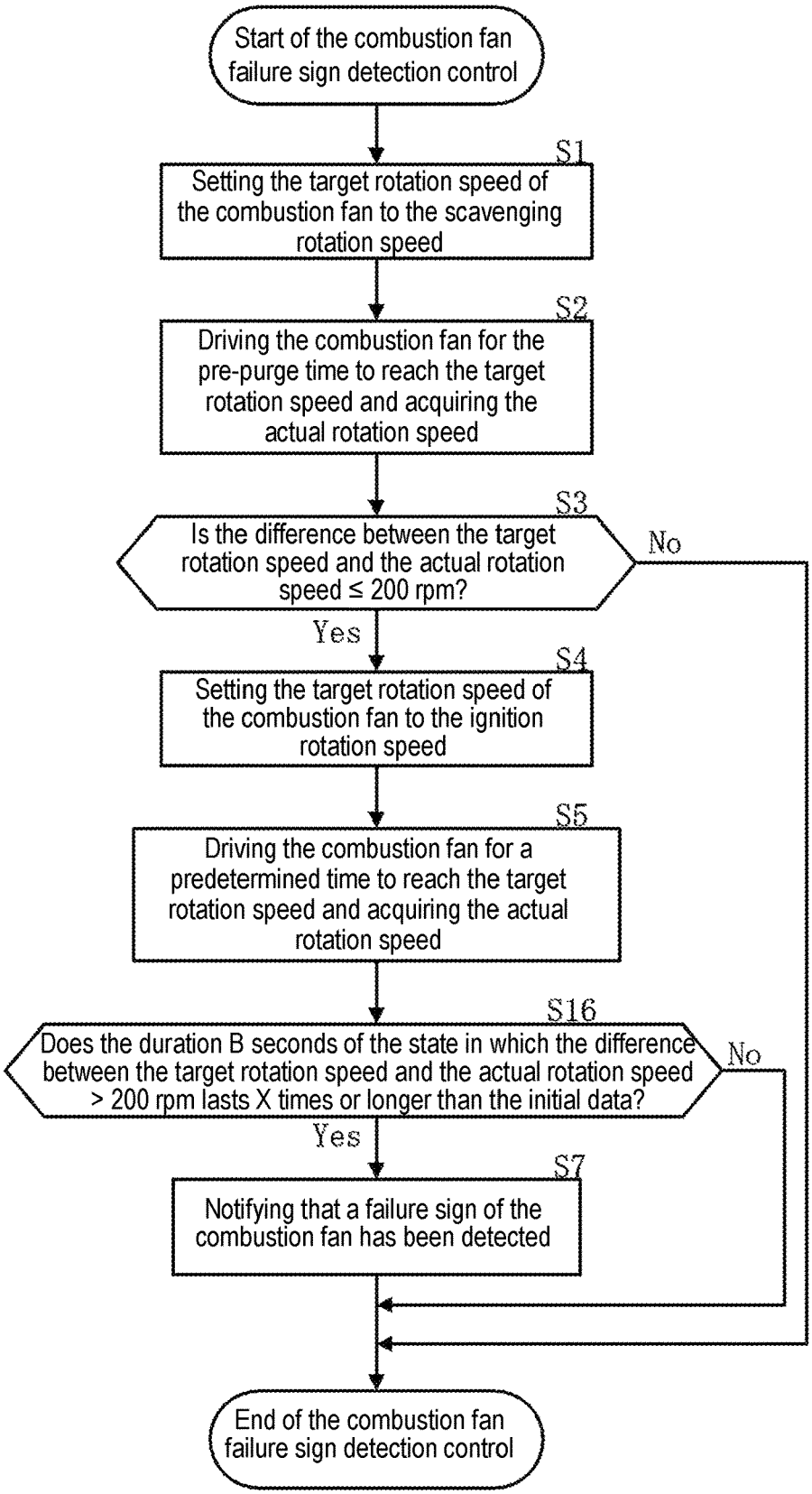
FIG. 5 is a flowchart of a combustion fan failure sign detection control according to a second detection example.

The combustion fan failure sign detection control of a second detection example in which the first detection example is partially modified will be described with reference to the flowchart of FIG. 5. The parts common to the first detection example are designated by the same reference numerals as those of the first detection example, and the description thereof will be omitted.

The configuration of the hot water supply device 1 is the same as that of the first detection example. In the pre-purge step of the heating operation of the hot water supply device 1, it is determined whether there is a disturbance factor that hinders the rotation of the combustion fan 8 as in S1 to S3, and if there is no disturbance factor and the determination is Yes, the process proceeds to the ignition step and proceeds to S4. If the determination is No because there is a disturbance factor, the combustion fan failure sign detection control is ended, and the process proceeds to the ignition step to continue the heating operation.

In S4, the target rotation speed of the combustion fan 8 is set to the ignition rotation speed, and the process proceeds to S5. Then, in S5, the combustion fan 8 is driven for a predetermined time (for example, 7 seconds) so as to reach the ignition rotation speed that is the target rotation speed, and the actual rotation speed during that period is acquired, and the process proceeds to S16.

In S16, as a comparison with the initial data, it is determined whether the duration B seconds of the state in which the difference between the target rotation speed and the actual rotation speed exceeds 200 rpm lasts X times (for example, 10 times) or longer than the initial data at the time of initial installation of the hot water supply device 1. The initial data is data collected during the trial run of the hot water supply device 1 and stored in the control part 16 (storage part 16*b*) or the management server 20, and the duration of the state in which the difference between the target rotation speed and the actual rotation speed in the initial data exceeds 200 rpm is, for example, about 0.3 seconds. Since it has already been determined in the pre-purge step that there is no disturbance factor, the state in which the deviation from the target rotation speed is large and the duration thereof represent the current degree of deterioration of the combustion fan 8 in which the rotational responsiveness has deteriorated.

If the determination in S16 is Yes, the process proceeds to S7. In this case, since the deterioration of the combustion fan 8 has progressed to some extent, in S7, it is notified that the failure sign of the combustion fan 8 has been detected, and the combustion fan failure sign detection control is ended, and the process proceeds to the combustion step to continue the heating operation. At this time, for example, the service shop is notified via the management server 20 that a failure sign has been detected to prompt for inspection, but the user can also be notified by, for example, lighting the lamp of the operation terminal 17.

On the other hand, when the determination in S16 is No, the deterioration of the combustion fan 8 has not progressed so much. Therefore, it is assumed that the failure sign of the combustion fan 8 has not been detected, and the combustion fan failure sign detection control is ended, and the process proceeds to the combustion step to continue the heating operation. Since the detection of the failure sign of the combustion fan 8 is performed every time the heating operation is performed as described above, it is unlikely to overlook the failure sign of the combustion fan 8. Further, since the presence or absence of a disturbance factor is determined and the failure sign detection is performed when there is no disturbance factor, it is possible to prevent the false detection of the failure sign due to the disturbance, and it is possible to reduce the amount of communication by preventing transmission and reception of initial data and false detection information of failure signs with the management server 20.

Third Detection Example

Figure 6:
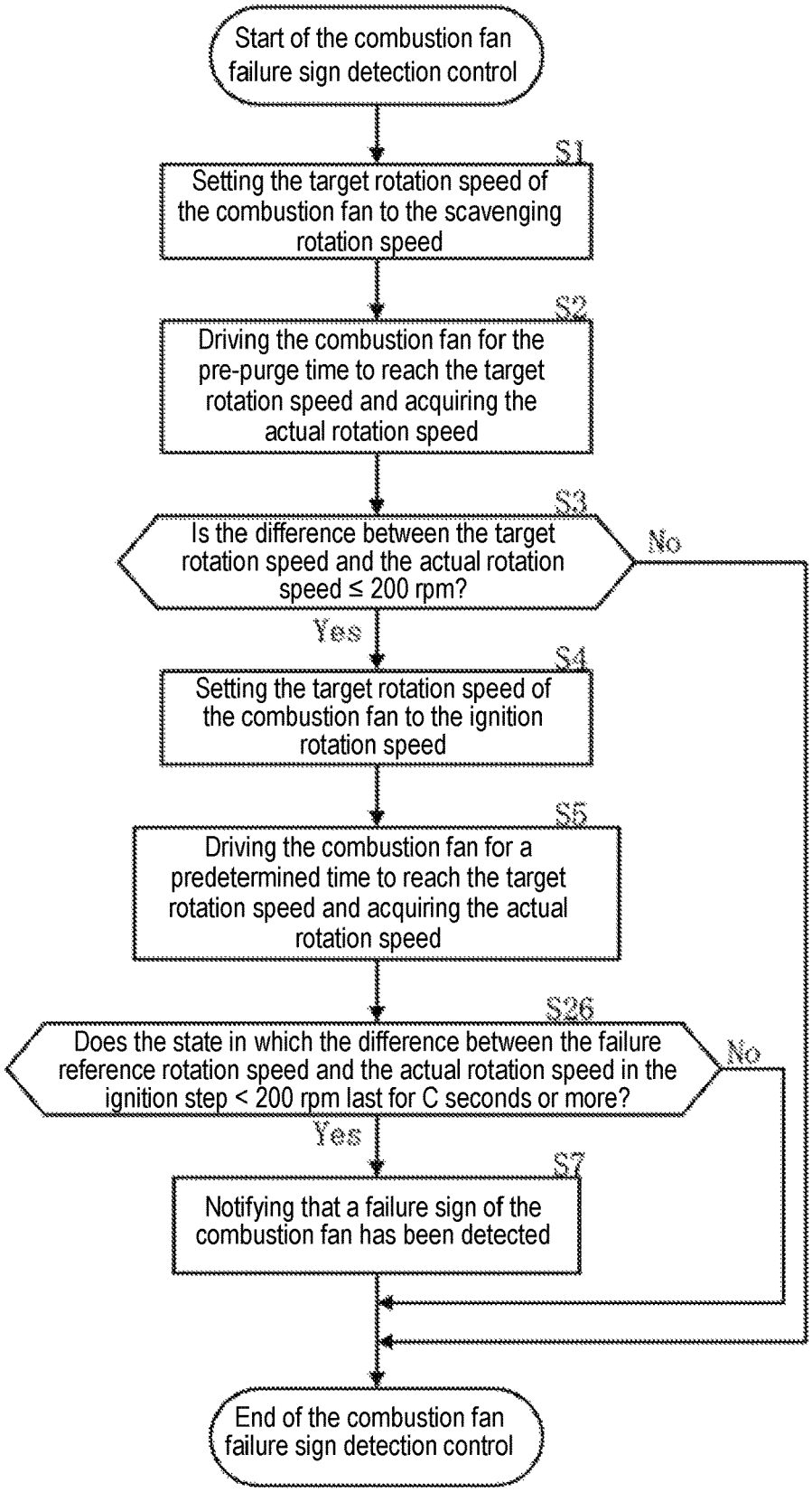
FIG. 6 is a flowchart of a combustion fan failure sign detection control according to a third detection example.

An example in which the first detection example is partially modified will be described with reference to the flowchart of FIG. 6. The parts common to the first detection example are designated by the same reference numerals as those of the first detection example, and the description thereof will be omitted.

The configuration of the hot water supply device 1 is the same as that of the first detection example. In the pre-purge step of the heating operation of the hot water supply device 1, it is determined whether there is a disturbance factor that hinders the rotation of the combustion fan 8 as in S1 to S3, and if there is no disturbance factor and the determination is Yes, the process proceeds to the ignition step and proceeds to S4. If the determination is No because there is a disturbance factor, the combustion fan failure sign detection control is ended, and the process proceeds to the ignition step to continue the heating operation.

In S4, the target rotation speed of the combustion fan 8 is set to the ignition rotation speed, and the process proceeds to S5. Then, in S5, the combustion fan 8 is driven for a predetermined time (for example, 7 seconds) so as to reach the ignition rotation speed that is the target rotation speed, and the actual rotation speed during that period is acquired, and the process proceeds to S26.

In S26, as a comparison with failure reference data, it is determined whether the state in which the difference between a failure reference rotation speed and the actual rotation speed is less than 200 rpm lasts for C seconds (for example, 5 seconds) or more. The failure reference rotation speed is set in advance as the upper and lower limit rotation speeds at which normal ignition and combustion can be performed based on the combustion experiment of the combustion part 2 or the like, and is stored in advance in the control part 16 (storage part 16*b*), for example, as +/−500 rpm with respect to the ignition rotation speed. Since it has already been determined that there is no disturbance factor in the pre-purge step, the state in which the difference between the failure reference rotation speed and the actual rotation speed is small, that is, the state in which the difference between the target rotation speed and the actual rotation speed is large, and the duration thereof represent the current degree of deterioration of the combustion fan 8 in which the rotational responsiveness has deteriorated.

When the duration of the state in which the actual rotation speed is within the range of the upper limit rotation speed and the rotation speed 200 rpm smaller than the upper limit, or of the state in which the actual rotation speed is within the range of the lower limit rotation speed and the rotation speed 200 rpm larger than the lower limit, lasts for C seconds or more, that is, when the determination in S26 is Yes, the process proceeds to S7. In this case, since the deterioration of the combustion fan 8 has progressed to some extent, in S7, it is notified that the failure sign of the combustion fan 8 has been detected, and the combustion fan failure sign detection control is ended, and the process proceeds to the combustion step to continue the heating operation. At this time, for example, the service shop is notified via the management server 20 that a failure sign has been detected to prompt for inspection, but the user can also be notified by, for example, lighting the lamp of the operation terminal 17.

On the other hand, when the determination in S26 is No, the deterioration of the combustion fan 8 has not progressed so much. Therefore, it is assumed that the failure sign of the combustion fan 8 has not been detected, and the combustion fan failure sign detection control is ended, and the process proceeds to the combustion step to continue the heating operation. Since the detection of the failure sign of the combustion fan 8 is performed every time the heating operation is performed as described above, it is unlikely to overlook the failure sign. Further, since the presence or absence of a disturbance factor is determined and the failure sign detection is performed when there is no disturbance factor, it is possible to prevent the false detection of the failure sign due to the disturbance, and it is possible to reduce the amount of communication by preventing the transmission of false detection information of failure signs to the management server 20.

The operation and effect of the hot water supply device 1 of the first embodiment will be described.

The control part 16 of the hot water supply device 1 determines the presence or absence of a disturbance factor in the pre-purge step based on the rotational responsiveness and deviation with respect to the target rotation speed of the combustion fan 8 during the heating operation, and if there is no disturbance factor, the detection of the failure sign of the combustion fan 8 is performed in the ignition step. Therefore, since the detection of the failure sign of the combustion fan 8 is performed every time the heating operation is performed, it is unlikely to overlook the failure sign, and since the presence or absence of the disturbance factor is determined, it is possible to prevent false detection of the failure sign due to the disturbance.

Further, when the detection of the failure sign of the combustion fan 8 is performed by comparing with the initial data at the time of initial installation of the hot water supply device 1, the failure sign due to the aged deterioration of the combustion fan 8 can be detected. Therefore, it is possible to prompt the inspection before the hot water supply device 1 cannot be operated due to the failure in the combustion fan 8.

In addition, when the detection of the failure sign of the combustion fan 8 is performed based on the comparison with the failure reference data in which the combustion fan 8 is determined to have a failure, the failure sign can be detected before the failure is determined. Therefore, it is possible to prompt the inspection before the hot water supply device 1 cannot be operated due to the failure in the combustion fan 8.

The case where the disturbance factor is determined in the pre-purge step and the detection of the failure sign is performed in the ignition step has been described as an example. However, for example, it is possible that, in the post-purge step, after the disturbance factor has been determined, the target rotation speed may be changed in the middle of the post-purge step to perform the detection of the failure sign. Further, the failure sign may be detected by the number of times (the fluctuation of the actual rotation speed) for which the actual rotation speed deviates from the reference in the predetermined driving time. It is also possible that when the current which drives the combustion fan 8 so that the actual rotation speed becomes the target rotation speed is increased or decreased, the detection of the failure sign is performed based on the initial data regarding the value of this current at the time of initial installation or based on the comparison with the failure standard.

Second Embodiment

Next, the heating operation of the hot water supply device according to the second embodiment will be described.

The hot water supply device (FIG. 1), the configuration and communication path of the control part of the hot water supply device (FIG. 2) and the steps of the heating operation of the hot water supply device (FIG. 3) are the same as those in the first embodiment, and thus the description thereof will be omitted.

In the heating operation, for example, the number of times of ignition retries (ignition time) in the ignition step and the fire transfer time in the combustion step tend to gradually increase due to aged deterioration. Then, for example, when the fire transfer time reaches the failure reference value for determining the occurrence of a blockage failure in the combustion part 2 stored in the control part 16, the control part 16 prohibits the heating operation for safety. Then, the control part 16 notifies the user of the occurrence of a failure in the combustion part 2 by, for example, the operation terminal 17, and notifies the service shop, for example, of the occurrence of the failure in the combustion part 2 via the management server 20. The user or the service shop that is notified of this failure arranges inspection and repair.

Figure 7:
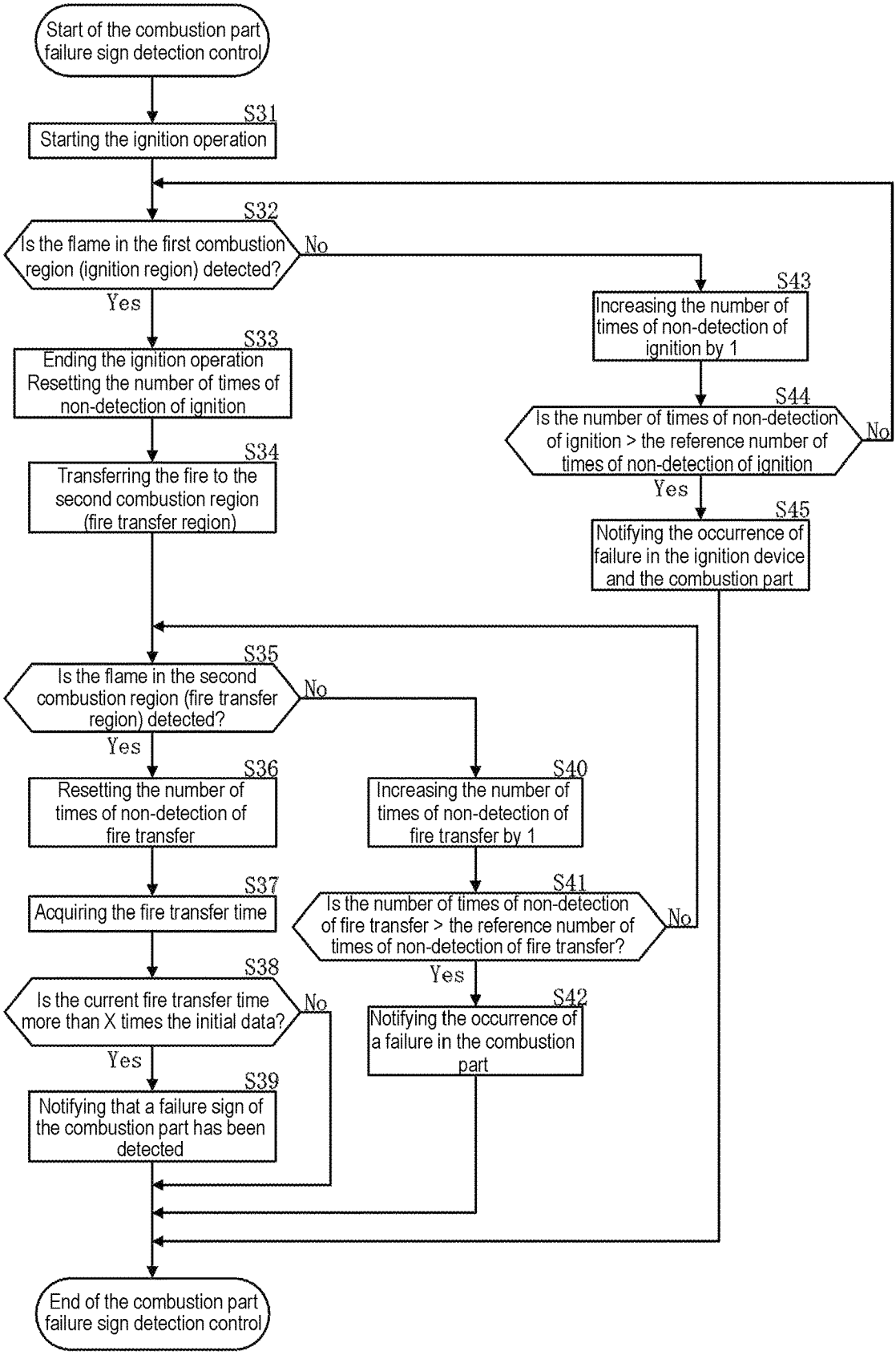
FIG. 7 is a flowchart of a combustion part failure sign detection control according to a second embodiment.

If only the occurrence of the failure in the combustion part 2 is notified, it causes inconvenience because the hot water supply device 1 cannot be used from the occurrence of the failure to the completion of inspection and repair. Therefore, the control part 16 detects the failure sign of the combustion part 2 before the failure, notifies the service shop that the failure sign has been detected via the management server 20, and prompts the inspection. The failure sign detection of the combustion part 2 will be described with reference to the flowchart of the combustion part failure sign detection control of FIG. 7 by the control part 16. Si (i=31, 32, . . . ) in the figure represents a step.

When the heating operation is started, the air accumulated in the combustion part 2 and the heat exchange part 3 is exhausted and fresh air is introduced in the pre-purge step, and when the process proceeds to the ignition step, the combustion part failure sign detection control is started. In S31, the ignition operation by the ignition device 14 is started, and the process proceeds to S32.

Next, in S32, it is determined whether a flame in the first combustion region 2*a* (ignition region) is detected. The detection of the flame is performed by detecting the current flowing through the first flame rod 15*a* via the flame at every predetermined time (for example, 0.5 seconds). If the ignition is successful and the flame can be detected and the determination in S32 is Yes, the process proceeds to S33. Then, in S33, the ignition operation is ended, and the number of times of non-detection of ignition is reset to zero, and the process proceeds to the combustion step and to S34. The number of times of non-detection of ignition is the number of times of a flame in S32 in this heating operation is not detected.

In S34, the rotation speed of the combustion fan 8 is increased so that the calculated required heat amount can be supplied, and the second gas solenoid valve 6*b* of the second combustion region 2*b* (fire transfer region) is opened, and the fire is transferred from the first combustion region 2*a* to the second combustion region 2*b*, and the process proceeds to S35. Then, in S35, it is determined whether a flame in the second combustion region 2*b* is detected. The detection of the flame is performed by detecting the current flowing through the second flame rod 15*b* via the flame at every predetermined time (for example, 0.5 seconds). If the fire transfer is successful and the flame is detected and the determination in S35 is Yes, the process proceeds to S36. If the determination in S35 is No, the process proceeds to S40.

In S36, the number of times of non-detection of fire transfer is reset to zero and the process proceeds to S37. The number of times of non-detection of fire transfer is the number of times a flame in the second combustion region 2*b* in S35 of this heating operation is not detected.

Then, in S37, the fire transfer time from the first combustion region 2*a* to the second combustion region 2*b* is acquired, and the process proceeds to S38. The fire transfer time is, for example, the time required from opening a second gas solenoid valve 12*b* to confirming the flame in the second combustion region 2*b* after confirming the flame in the first combustion region 2*a*. The fire transfer time may be acquired by measuring the time, or the fire transfer time may be acquired based on the predetermined time of flame detection and the number of times of non-detection of fire transfer.

In S38, the fire transfer time acquired in S37 is compared with the fire transfer time of the initial data stored in the control part 16 or the management server 20, and it is determined whether the current fire transfer time exceeds X times (for example, 7 times) of the initial data. If the fire transfer time increases and the determination in S38 is Yes, the process proceeds to S39. Then, in S39, it is notified that the failure sign of the combustion part 2 has been detected, and the combustion part failure sign detection control is ended while the heating operation is continued. If the determination in S38 is No, it is assumed that the failure sign of the combustion part 2 has not been detected, and the combustion part failure sign detection control is ended while the heating operation is continued.

If the determination in S35 is No, in S40, the number of times of non-detection of fire transfer is increased by 1, and the process proceeds to S41; and in S41, it is determined whether the number of times of non-detection of fire transfer exceeds the reference number of times of non-detection of fire transfer. When the failure reference value for determining the occurrence of a blockage failure in the combustion part 2 is set to, for example, 5 seconds, the reference number of times of non-detection of fire transfer is set to 10 times, and when the fire transfer time exceeds the failure reference value based on the predetermined time of flame detection and the number of times of non-detection of fire transfer, it is determined that a blockage failure in the combustion part 2 has occurred. It is also possible to perform a determination based on the measured fire transfer time and the failure reference value.

If the determination in S41 is No, the process returns to S35. If the determination in S41 is Yes, the process proceeds to S42, and in S42, the occurrence of a failure in the combustion part 2 is notified, and the process proceeds to the post-purge step in order to end the heating operation, and the combustion part failure sign detection control is ended.

On the other hand, if the flame in the first combustion region 2*a* cannot be confirmed in the ignition step and the determination in S32 is No, the process proceeds to S43, and in S43, the number of times of non-detection of ignition is increased by 1, and the process proceeds to S44. Then, in S44, it is determined whether the number of times of non-detection of ignition exceeds the reference number of times of non-detection of ignition. The reference number of times of non-detection of ignition is set in advance to, for example, 10 times.

If the determination in S44 is No, the process returns to S32. If the determination in S44 is Yes, the process proceeds to S45, and in S45, the occurrence of a failure in the ignition device 14 and a blockage failure in the combustion part 2 is notified, and the process proceeds to the post-purge step to end the heating operation, and the combustion part failure sign detection control is ended. Since it is unknown whether the cause of the ignition failure is in the ignition device 14 or the combustion part 2, the cause is identified and repaired at the time of inspection.

The operation and effect of the hot water supply device 1 of the second embodiment will be described.

The control part 16 of the hot water supply device 1 ignites the first combustion region 2*a* (ignition region) of the combustion part 2 during the heating operation to make it burn, and then detection of a failure sign of the combustion part 2 is performed based on the fire transfer time when the combustion region is expanded to the second combustion region 2*b* (fire transfer region) adjacent to the first combustion region 2*a*. Therefore, it is possible to prevent false detection of a failure sign due to disturbance by preventing the influence of the ignition device 14 and the influence of strong wind.

Further, since the detection of the failure sign of the combustion part 2 is performed by comparing with the initial data at the time of initial installation of the hot water supply device 1, the failure sign due to the aged deterioration of the combustion part 2 can be detected. Therefore, it is possible to prompt the inspection before the hot water supply device 1 cannot be operated due to the failure in the combustion part 2.

The blockage failure of the combustion part 2 is determined based on the comparison between the current fire transfer time and the failure reference value for determining the occurrence of the blockage failure in the combustion part 2. Therefore, it is possible to prevent erroneous determination of the blockage failure in the combustion part 2 due to disturbance, and it is possible to notify the blockage failure in the combustion part 2 for safety when it is determined that the blockage failure in the combustion part 2 has occurred.

For example, when the increase in the fire transfer time is caused by soot gradually accumulating in the flame hole of the combustion part 2 and blocking the flame, as the soot accumulation progresses and the opening diameter of the flame hole becomes smaller, the speed at which the opening diameter becomes smaller increases, and the increase rate of the fire transfer time becomes larger. Therefore, for example, it is possible to compare the previous and current fire transfer times and detect a failure sign based on the increase rate of the fire transfer time.

In addition, a person skilled in the art may carry out the disclosure in a form in which various modifications are added to the above embodiments without departing from the spirit of the disclosure, and the disclosure includes such modifications.

What is claimed is:

1. A hot water supply device, comprising:

a combustion part;

a gas supply part for supplying fuel gas to the combustion part;

a combustion fan for supplying combustion air to the combustion part;

a heat exchange part;

a water supply part;

an exhaust port for exhausting combustion gas to outside;

a hot water discharge part; and a control part, wherein the hot water supply device is configured to perform a heating operation in which hot water supplied from the water supply part is heated in the heat exchange part by combustion heat generated in the combustion part to discharge the hot water at the hot water discharge part, and the control part performs detection and notification of a failure sign of a plurality of elemental components configuring the hot water supply device based on responsiveness and deviation with respect to a control target value in the heating operation, wherein in the hot water supply device, the heating operation is operated by controlling a plurality of steps set for each of the plurality of elemental components, and the control part determines a status of the hot water supply device based on responsiveness and deviation with respect to a control target value detected in an initial step among the plurality of steps, and when it is determined that the status is normal, the control part performs the detection of the failure sign based on responsiveness and deviation with respect to a control target value detected in a next step following the initial step, wherein the control part performs detection and notification of a failure sign of the combustion fan based on rotational responsiveness and deviation of the combustion fan with respect to a target rotation speed, the heating operation comprises:

a pre-purge step, which is the initial step that drives the combustion fan for a predetermined time with the target rotation speed set to a predetermined scavenging rotation speed; and an ignition step, which is the next step that drives the combustion fan with the target rotation speed set to a predetermined ignition rotation speed after the pre-purge step and performs an ignition operation, and in the pre-purge step, the control part determines a presence or absence of a disturbance factor from the outside based on the rotational responsiveness and the deviation of the combustion fan with respect to the scavenging rotation speed, which is the control target value, wherein when there is wind blowing into the exhaust port from the outside and flowing back to the outside, thereby causing a rotation speed of the combustion fan to be decreased, the control part determines that there is a disturbance factor and continues the heating operation by proceeding to the ignition step without performing the detection of the failure sign of the combustion fan, and when it is determined that there is no disturbance factor, the control part proceeds to the ignition step and performs the detection of the failure sign based on the rotational responsiveness and the deviation of the combustion fan with respect to the ignition rotation speed, which is the control target value.

2. The hot water supply device according to claim 1, wherein the control part stores in advance initial data at the time of initial installation related to the rotational responsiveness and the deviation of the combustion fan, and performs the detection of the failure sign by comparing current rotational responsiveness and deviation of the combustion fan with the initial data.

3. The hot water supply device according to claim 1, wherein the control part stores in advance failure reference data related to the rotational responsiveness and the deviation of the combustion fan determined to have a failure, and performs the detection of the failure sign by comparing current rotational responsiveness and deviation of the combustion fan with the failure reference data.

* * * * *